US005624308A

United States Patent [19]

Rumbach

[11] Patent Number: 5,624,308

[45] Date of Patent: Apr. 29, 1997

[54] SYSTEM FOR SORTING AND/OR COUNTING COINS BY MEANS OF A CIRCULAR SORTING TRACK

[75] Inventor: Karl F. Rumbach, Alfter-Witterschlick, Germany

[73] Assignee: Standardwerk Eugen Reis GmbH, Bruchsal, Germany

[21] Appl. No.: 527,164

[22] Filed: Sep. 12, 1995

[30] Foreign Application Priority Data

Sep. 15, 1994 [DE] Germany ..... 44 32 803.6

[51] Int. Cl.[6] ..... G07D 3/14; G07D 3/16

[52] U.S. Cl. ..... 453/3; 453/32

[58] Field of Search ..... 453/3, 4, 6, 10, 453/12, 32

[56] References Cited

U.S. PATENT DOCUMENTS 3,788,440 1/1974 Propice et al. ..... 453/3 X 4,088,143 5/1978 Bezsilko ..... 453/6

5,141,443 8/1992 Rasmussen et al. ..... 453/10

FOREIGN PATENT DOCUMENTS 0125132 3/1989 European Pat. Off. .

0138449 7/1991 European Pat. Off. .

3419589 5/1984 Germany .

*Primary Examiner*—F. J. Bartuska

*Attorney, Agent, or Firm*—Baker & Daniels

[57] ABSTRACT

A system for handling, sorting and/or counting disc-shaped objects, such as coins. A rotatable turntable having a loading tray into which the disc-shaped objects are introduced includes a peripheral circular entrainment sorting ring. A fixed upper circular ring is disposed immediately above the sorting ring whereby the disc-shaped objects are fed along the upper ring. A plurality of deflection devices are adapted to deflect the coins from between the upper ring and sorting ring. A control track extends from the loading tray to the sorting ring and is adapted to singularize and feed the disc-shaped objects. A recognition or counting device is positioned along the control track.

17 Claims, 4 Drawing Sheets

SYSTEM FOR SORTING AND/OR COUNTING COINS BY MEANS OF A CIRCULAR SORTING TRACK

BACKGROUND OF THE INVENTION

1. Field of the Invention

The present invention relates to a system for handling coins or similar disk-shaped objects wherein the coins are introduced by means of a turntable between a peripheral, circular entrainment ring of the turntable and a fixed upper circular ring provided with a deflection device.

2. Description of the Prior Art

Systems of this type are known insofar as loading and sorting take place on one and the same turntable via an inside circular loading surface and a sorting ring (refer to EP 0 125 132 and EP 0 138 449). These prior coin sorting systems have a very high capacity (up to about 6,000 coins per minute) and sort, or separate, from a jumble of different coins the same coins in accordance with their thickness or their diameter; in unloading the coins at the respective exit along the so-called sorting track, the respective coins are then counted.

Output and reliability of such coin sorting systems depend quite decisively upon the diameter difference, because coins of different value but the same or nearly same diameter cannot be separated. But incorrect sorting also means incorrect counting, since each coin-specific exit has a value assigned to it, and such incorrect sorting constitutes the essential disadvantage of the prior coin sorting systems.

In terms of engineering, the aforementioned coin sorting systems are comprised of a rotating disk which on its entire circular surface is covered with an elastic material. Carried along by frictional engagement, the coins are forced into sorting channels, which are fashioned as recesses machined in a circular ring matching the coin diameter. A center hole in this circular ring represents the loading hole; the sorting channels capture then the specifically assigned, or assignable coins in accordance with their diameter and carry them—driven by frictional engagement by the rotating lower disk with elastic covering—to the coin-specific exits arranged on the circumference of the sorting circle. At these exits, the sorted coins are then counted.

The prior coin sorting systems are suited only for counting coins with different diameters; foreign and/or false coins as well as coins with the same or nearly same diameter but different value can thus not be sorted out.

All prior coin sorting systems count the coins only at their sort-out openings, and at that, in a way such that the coins dropping in the opening are being counted. Owing to shortcomings in separation, false coins are ultimately counted, with "false" meaning here all coins which do not pertain specifically to a sorting opening, or separating or deflection switch.

A particular problem is encountered in conjunction with prior coin sorting systems in sorting and exact counting of predetermined amounts of coins in bagging and/or wrapping. The problem involved is that upon recognition, or counting, of the last (n-th) coin of the preset amount of coins to be bagged, at the sorting opening, the sorting disk must be stopped, and a straggling of the (n+1)th coin cannot be prevented in certain sequential constellations. While attempts are being made to assure accurate counting by expensive accessory devices, the additional expense far outweighs the benefits achieved.

SUMMARY OF THE INVENTION

The objective underlying the present invention is to eliminate the aforementioned problems and provide a system of the categorical type which reliably recognizes, counts and separates coins of any kind and which guarantees an optimum operation in view of the bagging problems cited.

The above objective is accomplished by providing between the loading tray and the peripheral circular sorting ring a control track that singularizes the coins and feeds them at a controlled relative spacing via recognition and/or counting devices as well as deflection and/or stop devices to the sorting ring.

The core of the present invention is constituted by the functional separation of the inside loading tray and the outside sorting track of the same rotating turntable and by carrying the coins from the loading circle, via a "control track" with at least one coin recognition system, to the sorting track. In addition to the specific recognition of each individual coin prior to entering the sorting track, all coins (independent of diameter) are counted and clearly assigned to the individual deflection and return mechanisms. False and/or foreign coins, also when matching a genuine coin in diameter, can be sorted out along the control track (by means of a deflection device arranged there) or not until reaching the sorting ring (by means of a separate deflection device). In this context it should be noted that along with separating foreign and false coins, but also with separating surplus "good" coins in the case of a sorting and/or counting result corresponding to a presetting there is also possible a return of these coins to the loading tray.

A coin recognition system of the type according to the present invention can be equipped with sensors of different specifications, so that the coins to be sorted (and counted) can be checked also regarding their thickness, alloy and engraving (i.e., their design) and, as the case may be, their knurling. Based on this identification criteria it is possible to recognize the coins centrally, before transfer to the sorting disk, and to generate, e.g., control or deflection signals which accompany the path of a coin along the sorting track insofar as they can be sorted out (as a false coin, for instance) of the coin stream, e.g., before being channeled into the sorting track, or can be separated reliably from same-diameter coins (of different value) along the sorting track. This unequivocal recognition and tracking of all coins prior to feeding them to the sorting track, or along the sorting track, also allows the previously mentioned realization of the reliable and clear return mechanism, making it possible to bag or wrap a predetermined amount of same coins at any time.

A particular advantage of the control track is also that, due to the singularizing devices known in conjunction with coin sorting systems, withdrawal of the coins from the loading tray proceeds orderly and in a defined manner, by way of a difference between the feed velocity and withdrawal velocity at the transfer from the loading tray to the control track. Thus, no uncontrolled pressure can be created on the coins in their transfer and, likewise, it is not possible for the coins to directly touch, that is, travel along the sorting track while in mutual contact.

One particular embodiment is constituted by assigning to the turntable comprised of a loading tray and a sorting ring, for coin separation and coin sorting with the control track which functionally joins the functional units, a return mechanism by which coins can be returned to the loading tray at the end of a sorting operation, and thus at the end of the sorting ring. In conjunction with this coin sorting and counting system, the return mechanism is integrated when each coin is unequivocally identified via a control track at the transition between the loading tray and the sorting ring and the sorting operation along the circular ring takes place not solely via the coin diameter, i.e., solely by mechanical criteria. The basic premise is that the application does not hinge on the coin sorting operation as such, but that the coin sorting and counting system is meant to be used as an output device for outputting very specific coin aggregates preset via the coin recognition system. The particular advantages of a coin sorting and counting system equipped with such a return mechanism include, for example, the ability to perform bagging operations without any stopping, since the (n+1)th coin, e.g., simply is returned to the loading tray.

Moreover, as already mentioned, preset coin mixes can be compiled and individual coin values can also be sorted out of any coin mix, and separate coin values can be assembled at a very specific ratio.

Integrated in the fixed upper circular ring are deflection mechanisms in the form of recessed deflection switches which are controlled via the central recognition sensor and depending on the motion of the separate coins along the circular ring and which, from engineering aspects, are entirely independent of the diameter and thickness of the coin to be "handled."

A specific switch design allows passing the coins outward via the sorting ring in accordance with preset sorting criteria and collecting the coins then in appropriate containers (bags, cassettes or the like). A specific guide at the transition from the control track to the sorting ring guarantees an exact guidance of the coins along the sorting ring.

Arranged at the end of the ring, that is, where all of the coins arrive which have not been deflected, or channeled out, is the previously mentioned return device by which the coins are returned to the inside loading tray.

A coin sorting device of the kind described is suitably provided with centrally controlled deflection mechanisms. But the central recognition and counting does not preclude in principle, as a variant, segregation that is not centrally controlled and depends on diameter. In this case, false and foreign coins would need to be segregated already on the control track, and a return would not be possible. A necessary stop device would need to be accommodated as well on the control track. But this variant should be chosen only for customer-specific applications, for instance where cost advantages can be realized.

As is obvious, a high-speed sorting machine of compact design is presented which is flexible, independent of mechanical and physical modifications and of the number of coins. In terms of output, versatility, functionality and flexibility, such a sorting machine is superior to any prior coin sorting machine. The compact design with the least possible moving parts and open access to all wear parts offers cost advantages in the manufacture, maintenance and repair in a uniquely apparent manner.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

DETAILED DESCRIPTION OF THE INVENTION

Figure 1:
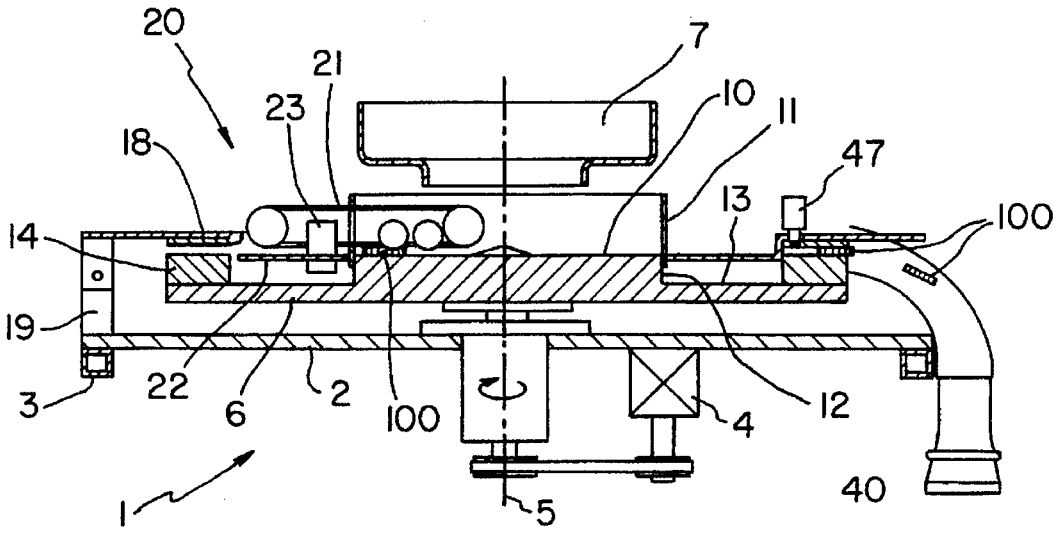
FIG. 1 is a cross-sectional schematic illustration of a system for sorting and/or counting coins in accordance with one form of the present invention.
Figure 2A:
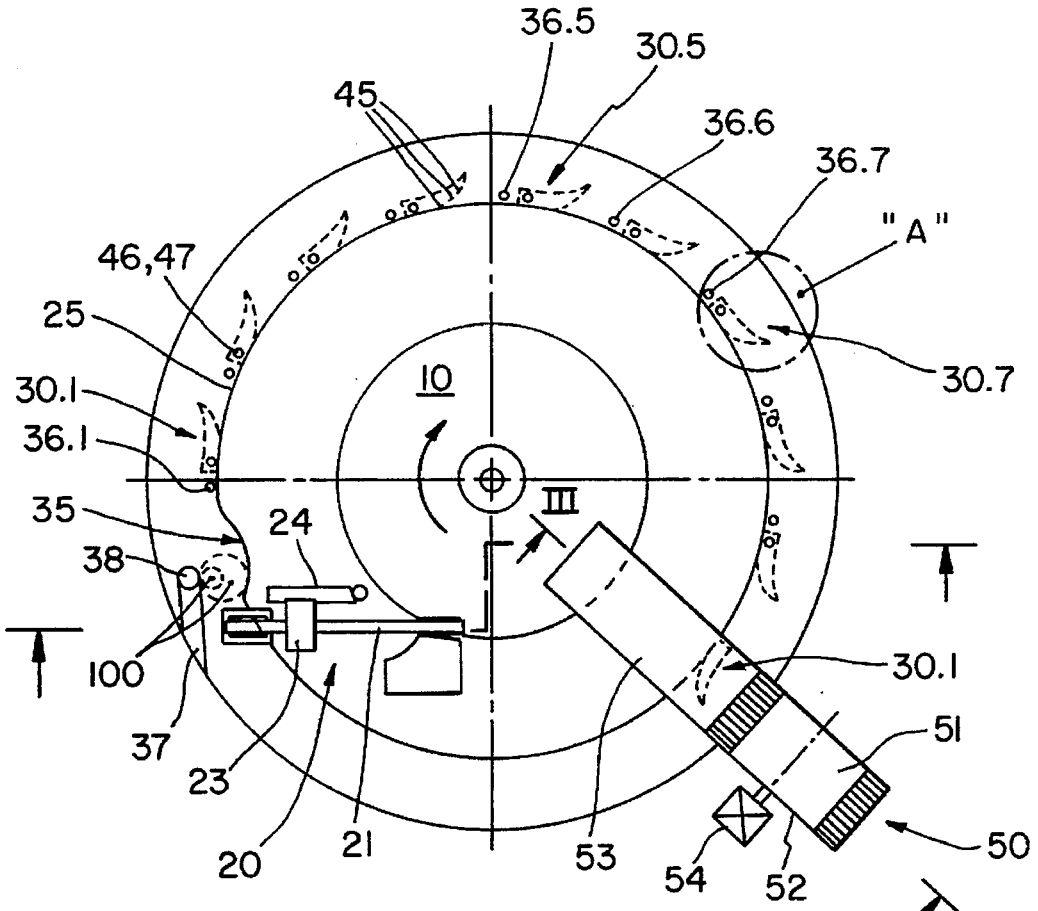
FIG. 2A is the system for sorting and/or counting coins according to FIG. 1 shown in plan view.
Figure 2B:
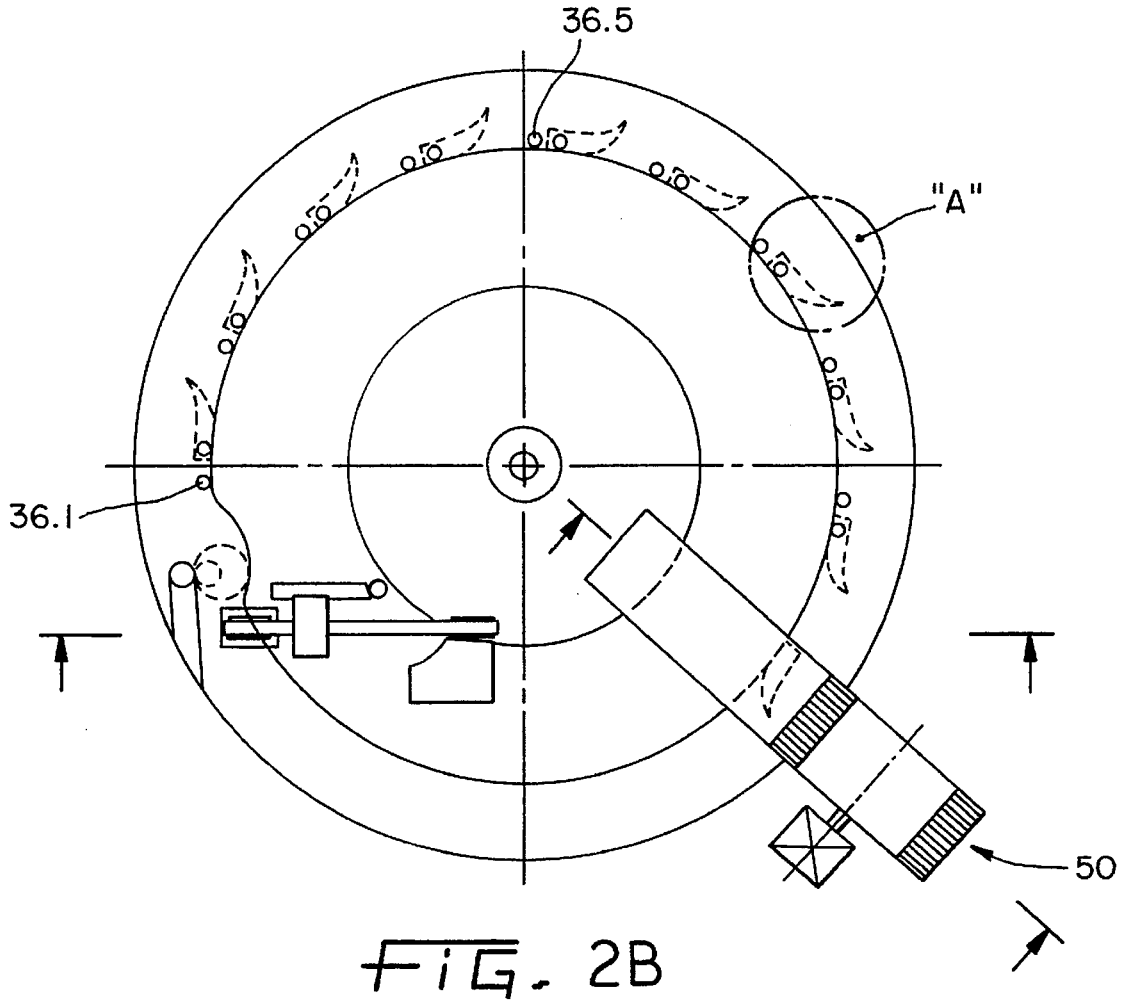
FIG. 2B is a plan view of another system for sorting and/or counting coins.

FIGS. 1 and 2A and 2B are schematic illustrations of a complete system 1 for sorting and/or counting coins 100. System 1 is mounted as an assembly on a base 2 which, in turn, rests on a frame 3.

The base 2 includes a flanged conduit through which protrudes an axle 5 driven by motor 4, axle 5 being coupled to a turntable 6 which forms the heart of the system for sorting and/or counting coins 100. Assigned to said turntable 6 is a coin supply container, for instance in the form of a coin tray 7, by way of which the coins 100 (or similar disk-shaped objects) to be sorted and/or counted are loaded on the turntable 6.

The turntable 6, as described below, has a very specific design. It features an inside (rotating and horizontal) loading tray 10 which peripherally is bounded by an upright skirting 11, thus forming a bowl or cup-shaped coin hopper. Bordering radially on the skirting 11 of the coin hopper, the turntable 6 has an offset creating a flange projection 13 which relative to the plane of the loading tray 10 is situated lower. The flange projection 13 features along its periphery a circular footing fitted with a covering 14 of elastic material (or—as shown pictorially—formed throughout by the material covering). Thus, turntable 6 presents itself as a relieved circular disk whose inside part forms the loading tray 10 and whose outer ring (hereafter called the sorting ring) with the elastic material covering 14 is offset relative to it.

The sorting ring is opposed from above by a fixed circular ring 18 which, in a particular design, is hinged in pivotable and lockable fashion to a console 19 joined to the base 2. In a functional sense, the sorting ring is opposed along its entire circumference by a circular ring 18. Provided between the sorting ring and circular ring 18 is a slot-shaped open space, the height of which is selected according to the coin 100 to be "handled."

Besides the rotary disk 6 and the drive as well as the frame for the rotary table 6, the illustration of FIGS. 1 and 2A and 2B depicts additionally a control track 20. Its purpose is transferring the coins 100 individually and successively from the loading tray 10 to the slot-shaped open space between the sorting ring and circular ring 18, thus bridging the relief between loading tray 10 and sorting ring 14. Viewed functionally and structurally, the control track 20 consists of a conveyer belt 21 which bounds tangentially on the loading tray 10 and feeds the coins 100 individually and spaced from one another along a rectilinear guide track 22 to the sorting ring. Arranged along guide track 22 is a well known coin recognition system 23 with a central field, in which system the coins 100 passed by it are each scanned and an appropriate, coin-specific signal is generated. Apart from the coin recognition system 23, a stop device as well as a separating, or deflection, system, as are well known in the art, for separation of foreign and false coins can be assigned along control track 20. In order for the individual coins 100 to travel exactly along control track 20 and through the coin recognition system 23, a guide strip 24 is provided, which is oriented virtually parallel to the conveyer belt 21.

Carried from the loading tray 10 via the conveyer belt 21 along the control track 20, the coins 100 are then passed to the circular sorting track formed by the sorting ring and circular ring 18 (FIGS. 2A and 2B), to which sorting track the coins 100 are individually transferred by the conveyer belt 21. The coins 100 are carried along by frictional engagement by means of the sorting ring and force-fed along a circular sorting ring 25 of the sorting track. Provided along the sorting track are separating or sorting stations or deflection devices (segregating stations) 30.1 (ten of them shown in the drawing), of which each allows coin-specific activation. It is conceivable to fashion the separating stations, or deflection devices, 30.1 as diameter-dependant segregating holes. Presently, the separating device 30.1 nearest the control track 20 segregates the coins 100 with the smallest diameter, and the one farthest away, 30.10, the coins 100 with the largest diameter. But also possible are separating stations, or deflection devices 30.1 which deflect coins 100 on the basis of nonmechanical differentiation criteria—allowing, for instance, in the deflection device 30.1 segregation of the largest, and in the farthest deflection device 30.10 the smallest coins.

To safeguard at the entrance to the sorting track also exact guidance along the circular sorting ring 25, of the coins 100 fed individually from the control track 20, a specific guide 35 is provided to which an alignment edge 37 with a ball bearing 38 is assigned, by way of which each individual coin 100 approaches the circular sorting ring 25.

Figure 5:
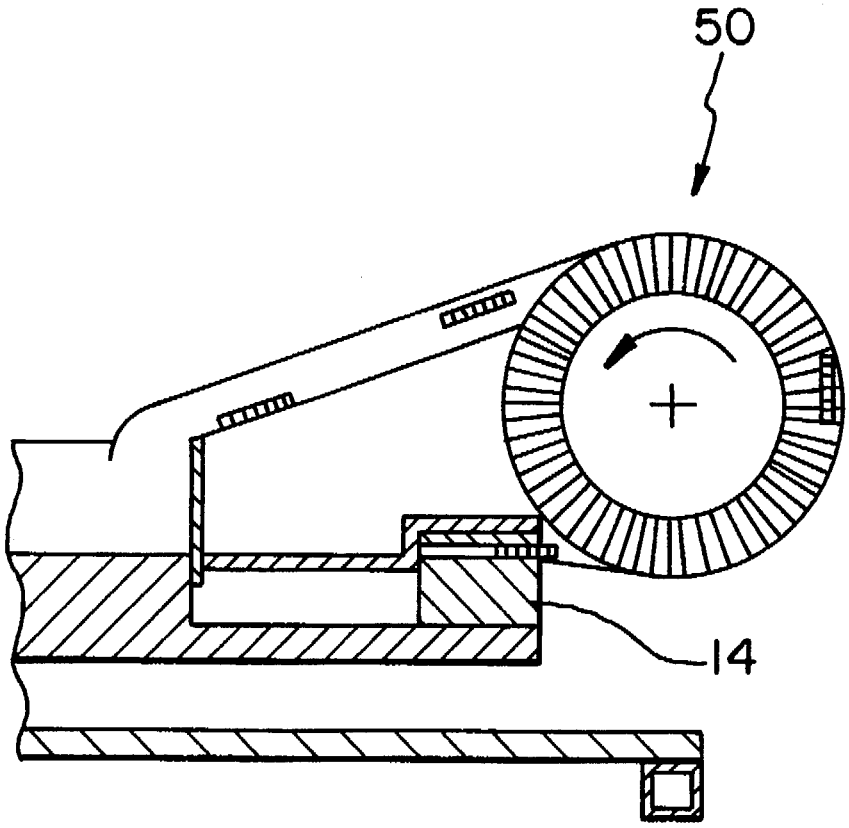
FIG. 5 is a sectional view of the coin conveyor system of FIG. 2A.

A coin conveyor system 50 is shown in FIGS. 2A and 5 which returns coins from the circular sorting ring 25 to the coin tray 7.

The system 1 described with the aid of FIGS. 1 and 2A and 2B, for sorting and/or counting coins, operates generally as follows:

The unsorted and uncounted coin mix is via the coin tray 7 fed to the loading tray 10. Centrifugal force pushes the coins 100 to the rim area of the loading tray 10, while the conveyer belt 21 of the control track 20 withdraws the coins separately and mutually spaced. Upon passage of the coin recognition system 23, the coins 100 are then aligned via the guide 35 on the circular sorting ring 25, squeezed between the sorting ring and circular ring 18, and carried along by frictional engagement.

Based on the coin signals generated in the coin recognition system 23, one of the deflection devices 30.1 of the selected separating station is activated, with the coin 100 then being carried via a deflection switch of a deflection device 30.1 radially outward and proceeding into a coordinated container, for instance a coin bag 40.

As regards feeding the individual coins 100 to the sorting track, it is noted that the gap between the sorting ring and circular ring 18 in the entrance area is first wider than the thickest coin 100. This guarantees nonproblematic channeling of the coins 100 onto the diameter of the sorting track. Viewed in the direction of rotation of the turntable 6, the gap narrows then, with the coins 100 being reliably captured and carried along. The width of the elastic material covering 14 of the sorting ring is preferably larger than the diameter of the largest coin 100, and its thickness, or elasticity is preferably so selected that it decreases from inside out in accordance with the thickness difference of the coins 100 to be "handled."

Each of the individual sorting stations may be assigned a positioning sensor of its own. This allows tracking every coin 100 from station to station, and it is readily obvious that a very exact activation of the deflection devices is achievable thereby.

Figure 3A:
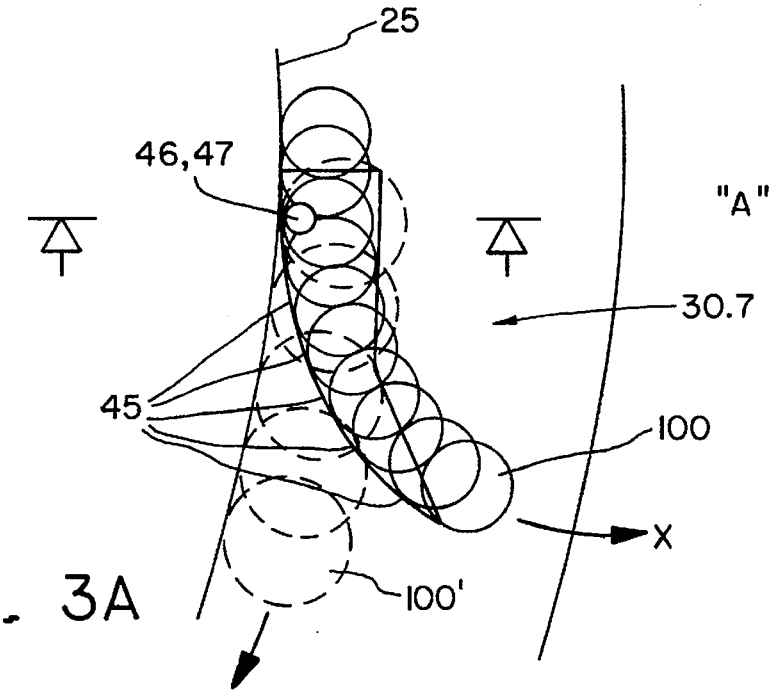
FIG. 3A is a sectional view of the area "A" of FIG. 2A.
Figure 3B:
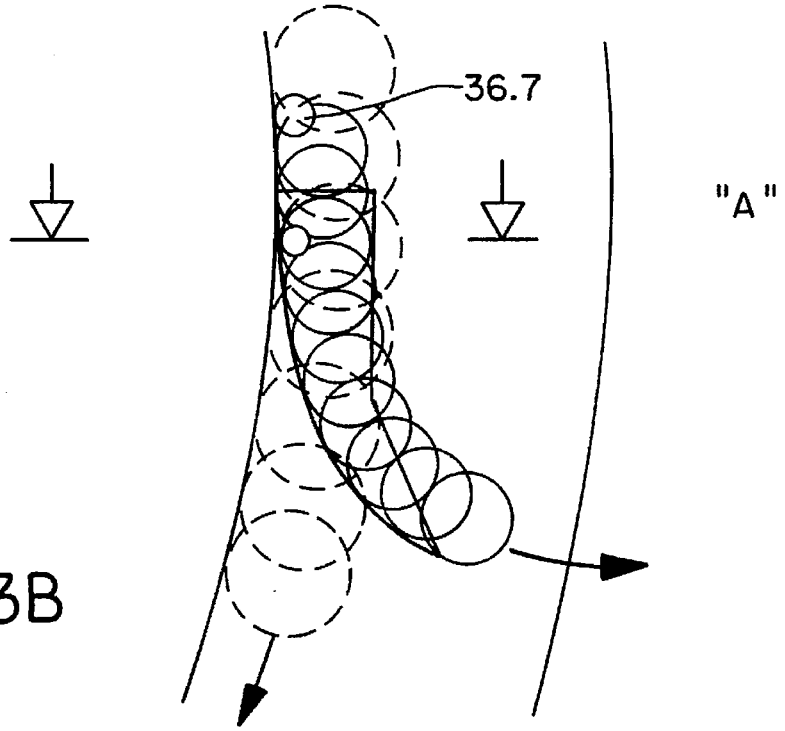
FIG. 3B is a sectional view of the areas "A" of FIG. 2B.

Positioning sensors, e.g., 36.1 and 36.6, are illustrated in FIG. 2A. FIG. 3A illustrates Detail "A" of FIG. 2A and shows positioning sensor 3.7.

As already mentioned initially, a significant advantage of the present invention, among others, is the ability for the return of false and/or foreign coins, and all coins 100 which somehow escaped separating during a pass, to the coin tray 7. These coins 100 can then be deflected, for instance at the last switch 30.10 of the sorting track, and rerouted to the loading tray 10 by way of an appropriate feed system.

As regards the overall system 1 for sorting and/or counting coins 100 in accordance with the illustrations in FIGS. 1 and 2A and 2B, it is noted that, in principle, more than one control track 20 can be integrated. This allows boosting the efficiency of a coin sorting system quite significantly.

FIGS. 3A and 3B, 4A and 4B, describe hereafter the deflection system 30.7, or the pertaining deflection switch corresponding to detail "A" of FIGS. 2A and 2B more fully. According to FIG. 3A, a coin 100 is successively carried along the circular sorting ring 25 by the sorting ring. The dashed coin 100' is meant to be separated later, that is, coin 100' is supposed to bypass the switch of the deflection system 30.7; only the following coin 100—shown in solid line—is meant to be sorted out at the deflection device 30.7.

Figure 4A:
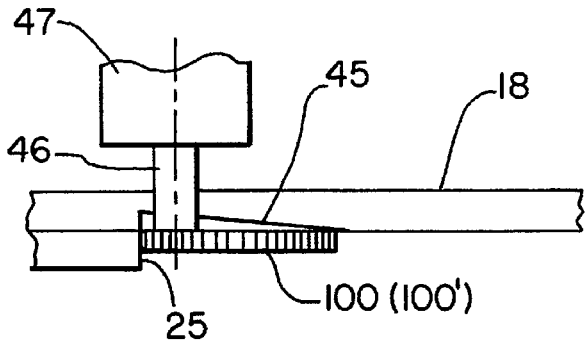
FIG. 4A is a cross-sectional illustration of a deflection switch which shows the control element for coin deflection in home position.
Figure 4B:
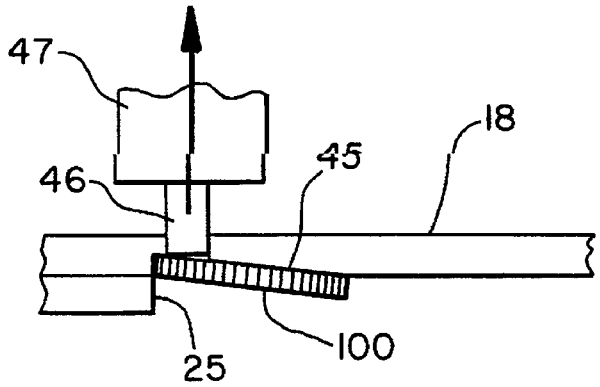
FIG. 4B is a similar view showing the control element in sorting position.

An important feature of a deflection device 30.1 is a skew recess 45 in the fixed circular ring 18, which recess extends FIGS. 4A and 4B, for one, flush with the circular sorting ring 25 and, on the other hand—viewed in the direction of rotation—outward in curved fashion. Any coin 100 tipping into recess 45 is passed outward along the curved guide edge away from the sorting track indicated by arrow X.

Normally, a coin 100 is passed along the circular sorting ring 25 in the range of a recess 45 across an extended plunger 46 of a magnet entrance component 47. A flat, homogeneous circular track is retained for the coin 100 FIG. 4A.

With a coin 100 following that needs to be separated, the plunger 46 is activated, that is, retracted. Owing to the contact pressure exerted by the sorting ring, the approaching coin 100 tips into the recess 45 (refer to FIG. 4B) and, thus, is carried off sideways in accordance with the curve shape of the recess 45.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A system for handling coins and similar disk-shaped objects, comprising:

a circular turntable having a loading tray for receiving the coins;

a circular sorting ring disposed on the periphery of the turntable;

a fixed circular ring provided with deflection devices and disposed adjacent to the sorting ring, whereby said sorting ring engages and transports the coins along the circular ring;

a control track disposed between said loading tray and said sorting ring, wherein said control track singularizes the coins and transports the coins at spaced intervals from the loading tray to the sorting ring; and at least one of a coin recognition device and a coin counting device is operatively disposed along said control track.

2. A system for handling disc-shaped objects such as coins, comprising:

a rotatable turntable having a loading tray into which the disc-shaped objects are introduced, said turntable having a peripheral circular entrainment sorting ring;

a fixed upper circular ring disposed immediately above said sorting ring, whereby the disc-shaped objects are transported along said upper ring by said rotating sorting ring;

a plurality of deflection devices on said upper ring adapted to deflect the disc-shaped objects from between said upper ring and said sorting ring;

a singularizing and feeding control track conveyor extending from said loading tray to said peripheral sorting ring adapted to singularize and feed the disc shaped objects to said peripheral sorting ring; and at least one of a recognition device and a counting device for the disc-shaped objects positioned along said control track conveyor.

3. The system of claim 2 further comprising a guide disposed between said control track conveyor and said sorting ring, whereby said guide aligns the disc-shaped objects along one of an inner and an outer edge of said sorting ring.

4. A system for handling coins according to claim 3 wherein said disc-shaped objects include a largest disc-shaped object, and the sorting ring further comprises an elastic footing having a width slightly greater than the diameter of the largest disc-shaped object and said elastic footing has one of a thickness and elasticity which varies from an interior edge to an exterior edge of said footing in accordance with a thickness difference of the disc-shaped objects to be handled.

5. A system for handling coins according to claim 2 wherein said disc-shaped objects include a largest disc-shaped object, and the sorting ring further comprises an elastic footing having a width slightly greater than the diameter of the largest disc-shaped object and said elastic footing has one of a thickness and elasticity which varies from an interior edge to an exterior edge of said footing in accordance with a thickness difference of the disc-shaped objects to be handled.

6. The system of claim 5 further comprising positioning sensors disposed along the circular upper ring whereby the disc-shaped objects are tracked along said circular upper ring and a selective activation of said deflection devices is achieved.

7. The system of claim 2 further comprising positioning sensors disposed along the circular upper ring whereby the disc-shaped objects are tracked along said circular upper ring and a selective activation of said deflection devices is achieved.

8. A system according to claim 7 further comprising a coin conveyor system disposed between said upper circular ring and said loading tray whereby coins are returned to said loading tray.

9. A system according to claim 2 further comprising a coin conveyor system disposed between said upper circular ring and said loading tray whereby coins are returned to said loading tray.

10. The system of claim 9 wherein said deflection devices comprise a deflection recess in the fixed circular upper ring whereby the disc-shaped objects are pushed into the deflection recess by an elastic footing located on said rotating sorting ring.

11. The system of claim 2 wherein said deflection devices comprise a deflection recess in the fixed circular upper ring whereby the disc-shaped objects are pushed into the deflection recess by an elastic footing located on said rotating sorting ring.

12. The system of claim 10 further comprising a retractable entry element whereby the disc-shaped objects transported by the circular sorting ring are pushed into the deflection recess and sorted when said entry element is retracted in response to a sorting signal.

13. The system of claim 12 wherein said entry element is solenoid controlled.

14. A system for handling disc-shaped objects, comprising:

a rotatable turntable having a loading tray into which the disc-shaped objects are introduced, said turntable having a peripheral circular entrainment sorting ring means for transporting said disc-shaped objects;

a fixed upper circular ring disposed immediately above said sorting ring means, said sorting ring means cooperating with said upper ring to transport the disc-shaped objects along said upper ring;

a plurality of deflection means on said upper ring for deflecting disc-shaped objects from between said upper ring and said sorting ring means;

a control track means extending from said loading tray to said peripheral sorting ring means for singularizing said disc-shaped objects and transporting said disc-shaped objects at spaced intervals from said loading tray to said sorting ring means; and one of a recognition means and counting means for sensing said disc-shaped objects positioned along said control track means.

15. The system of claim 14 including a guide means for aligning the disc-shaped objects along one of an inner and an outer edge of said sorting ring means.

16. The system of claim 14 wherein the disc-shaped objects include a largest disc-shaped object, and the peripheral sorting ring means further comprises an elastic footing having a width slightly greater than a diameter of the largest disc-shaped object and said elastic footing has one of a thickness and elasticity which varies from an interior edge to an exterior edge of said footing in accordance with a thickness difference of the disc-shaped objects to be handled.

17. The system of claim 14 further comprising a plurality of positioning sensor means disposed along said upper circular ring for tracking the disc-shaped objects along said upper circular ring whereby said deflection means are selectively actuated.

* * * * *